US005289959A

United States Patent [19]

Beeley et al.

[11] Patent Number: 5,289,959

[45] Date of Patent: Mar. 1, 1994

[54] INFANT RESCUE VEST

[76] Inventors: Robert A. Beeley; Brenda K. Oswalt; James Oswalt, all of P.O. Box 55549, Houston, Tex. 77255

[21] Appl. No.: 808,919

[22] Filed: Dec. 18, 1991

[51] Int. Cl.[5] ..... A61G 1/00

[52] U.S. Cl. ..... 224/160; 224/158; 224/159; 224/161; 224/209; 224/215

[58] Field of Search ..... 224/158, 159, 160, 161, 224/209, 215; D2/229, 190; D3/31, 32

[56] References Cited

U.S. PATENT DOCUMENTS

| | | | |
|---|---|---|---|
| D. 275,812 | 10/1984 | Deacon | D3/31 X |
| D. 307,821 | 5/1990 | Fallon . | |
| D. 315,632 | 3/1991 | Boyle | D2/190 X |
| D. 315,978 | 4/1991 | Scott | D2/190 X |
| 4,079,467 | 3/1978 | Baldwin | 224/159 X |
| 4,483,469 | 11/1984 | Arisland | 224/151 |
| 4,579,264 | 4/1986 | Napolitano | 224/158 X |
| 4,717,056 | 1/1988 | Carmichael | 224/158 |
| 4,783,862 | 11/1988 | Murphy . | |
| 4,903,873 | 2/1990 | Poole et al. . | |
| 4,923,104 | 5/1990 | Rice et al. | 224/160 X |
| 5,044,321 | 9/1991 | Selph | 224/160 X |

*Primary Examiner*—Allan N. Shoap
*Assistant Examiner*—Paul A. Schwarz

[57] ABSTRACT

The invention relates to emergency transportation of more than one infant at a time by one rescue person. A plurality of pockets are located on the front and back of the rescue vest garment. The pockets each contain a seat over which the infant straddles and a ventilation structure through which the infant breathes toward the rescue person. A pocket flap further shields the transported infant.

2 Claims, 1 Drawing Sheet

INFANT RESCUE VEST

This invention is in the field of infant rescue transportion devices.

BACKGROUND OF THE INVENTION

It is critical that infants may be evacuated from facilities such as hospital nurseries and day-care nurseries in a swift and saft manner under emergency conditions. It is important that several infants be evacuated by one attendant rather than just one infant at a time. It is important that infants be transported in such a way that they cannot be dropped or injured. In emergencies such as fires, it is also important that infants be protected from smoke and flying embers during transport.

A multi-pocket apron for carrying children is disclosed in U.S. Pat. No. Des. 275,812. The ornamental design depicts an apron to be worn by a person which covers only one side of a person, either front or back, and which contains six pockets on the front side of the apron. Three pockets are spaced across the width of the apron and the height of each pocket stretches from the middle of the apron to almost the top of the apron. The other three pockets are placed across the width of the apron and extend from the bottom of the apron to near the middle of the apron. The pockets appear to be ordinary pockets with no special features for placement of children within or for the protection of children from smoke or flying embers.

A rescue stretcher having a plurality of pockets spaced at intervals along the length thereof in which to place babies during evacuation is disclosed in U.S. Pat. No. 4,783,862. At least two attendants are required to transport the babies being evacuated by the stretcher and babies situated in the pouches of the stretcher are not entirely protected from exposure to smoke or flying embers in an evacuation through a fire.

A coat which includes a pocket for carrying an infant is disclosed in U.S. Pat. No. 4,079,467. The purpose of the coat is to provide an integral covering for both parent and child and to ready the child for the outdoors without requiring the parent to specially dress the child. The coat, however, would serve no particularly useful purpose in evacuating more than one baby at a time in an emergency situation.

The ornamental design for a twin baby carrier is disclosed in U.S. Pat. No. Des. 307,821. A limitation of such a carrier for emergency situations is that only two infants at a time may be transported in the carrier. There appear to be no special features for protecting infants transported in the carrier from smoke or other dangers inherent to fires.

SUMMARY OF THE INVENTION

It is an object of this invention to allow for the safe, efficient evacuation of one or more infants at a time by one person in an emergency situation. It is a further object of this invention to provide for a means of transport which shields the transported infants from smoke and embers which may be present in a fire.

Yet another object of the invention is to provide a garment for transporting one or more infants which protect the infants and which provides a means for ventilation.

Accordingly, these objects are achieved by this invention which is for a rescue vest suitable for transporting at least four infants at a time by one person and which includes features for protecting the transported infants from smoke and flying burning embers. The vest is designed to be quickly slipped over the attendant's head and to be securely placed on the attendant's body by virtue of wide shoulder portions and belts which secure the front panel to the back panel. Pockets are located on the front side of the front panel of the vest and on the front side of the back panel of the vest. Each pocket is large enough to house an infant. Each pocket contains ventilation mesh so that the infant may breathe oxygen while inside the pocket. There are straddle straps inside the pocket so that the infant may be placed in the pocket facing the attendant's body and not be permitted to turn around. Each pocket has a cover flap for the purpose of covering the opening of the pocket so that embers or debris cannot land directly on the infant's body.

BRIEF DESCRIPTION OF THE DRAWINGS

In the accompanying drawings, like numerals indicate like parts.

DETAILED DESCRIPTION OF THE INVENTION

Figure 1:
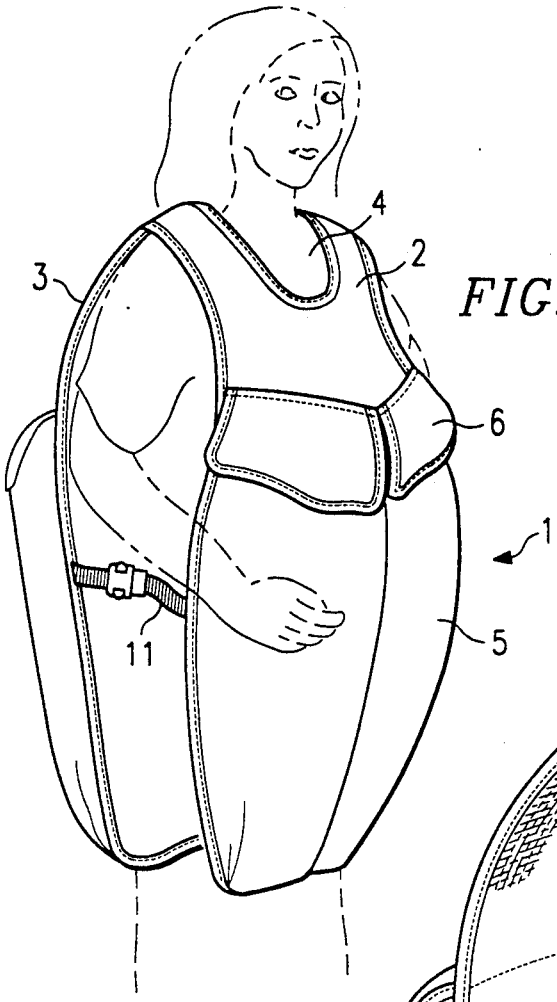
FIG. 1 is a perspective view of the rescue vest as worn by a rescuer.

Referring to FIG. 1, the rescue vest garment 1 to be worn on the body of a person is constructed of cordura or other suitable sturdy and flexible fire-resistant material. The garment 1 has a front panel 2 and a back panel 3 with an aperture 4 for the rescuer's head.

Figure 2:
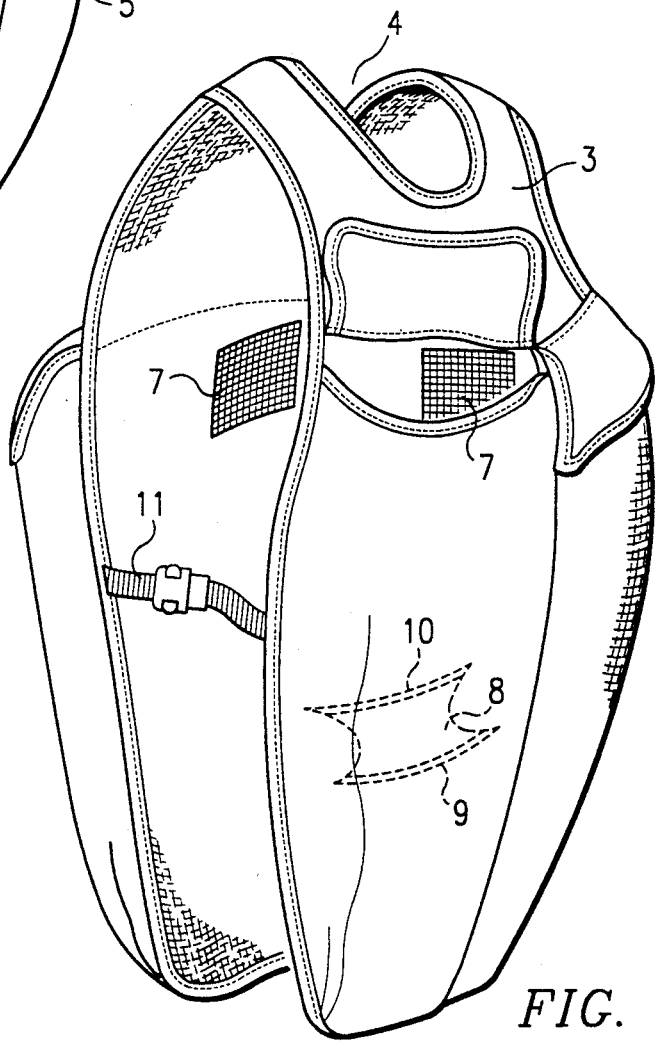
FIG. 2 is a perspective view of the exterior of the back panel and the interior of the front panel of the rescue vest garment showing the interior of a pocket.

Referring to FIG. 2, the back panel 3 is identical to the front panel 2.

Referring again to FIG. 1, the front panel 2 has attached to it on the exterior one or more pockets 5. The pocket 5 is large enough to contain an infant. A flap 6 is attached to the exterior of the garment above the upper end of the pocket.

Referring now to FIG. 2, when the flap 6 is lifted away from the pocket 5, the interior of the pocket 5 is accessible. Inside the pocket 5 near the upper end of the pocket 5 is a ventilation insert 7. Ventilation insert 7 may be made from a large number of well known materials, such as from some type of open weave material, so that the infant inside the pocket 5 will not suffocate.

Referring again to FIG. 2, the pocket 5 contains a straddle seat 8 on which the infant is seated. The straddle seat 8 is attached at one end 9 to the interior of the front of the pocket 5 and at the other end 10 to the interior of the back of the pocket 5. The infant's legs straddle the straddle seat 8, thereby confining the infant to one position, preferably facing the ventilation insert 7 and the rescuer.

The one piece rescue vest garment 1 is designed so that the garment 1 may be quickly placed over the head of one person. Infants may be quickly placed in the pockets 5 in front of the person, and then the person wearing the garment 1 may turn the garment 1 so that the infant-filled pockets 5 are in back of the person. By turning the infant-filled pockets 5 to the back of the person, the panel of the garment 1 with empty pockets 5 is now in front of the person. The rescuer may place more infants in the remaining pockets 5. To prevent the front panel 2 and the back panel 3 from swinging away from the rescuer's body, there is a belt 11 for attaching the front panel 2 to the back panel 3. One end of the belt 11 is attached to one side of the front panel 2 and the other end of the belt 11 is attached to the corresponding side of the back panel 3.

What is claimed is:

1. A rescue vest garment to be worn on the body of a person for rescuing infants comprising:

a front panel and a back panel having an aperture therethrough for the person's head;

a plurality of pockets attached to an exterior of the front panel, with one side of the pocket being formed by the front panel and with each of said pockets having an opening and each of said pockets being large enough to contain an infant passed through the opening of each of the pockets;

a flap attached above the opening of each of the pockets for covering the opening wherein when the flap is lifted away from the pocket, the pocket is accessible;

a ventilation insert for each of said pockets mounted in a side of the pocket formed by the front panel;

straddle means for each of said pockets comprising a straddle seat attached to an interior of the pocket below the ventilation insert wherein the infant's legs straddle said straddle seat thereby confining the infant in one position facing the ventilation insert; and a belt having opposing ends with one end attached to a side of the front panel and the other end attached to a side of the back panel.

2. The rescue vest garment of claim 1 further comprising:

a plurality of back panel pockets attached to an exterior of the back panel with one side of each back panel pocket being formed by the back panel and with each back panel pocket having an opening and each back panel pocket being large enough to contain an infant passed through the opening of each of the back panel pockets.

a back panel flap attached above the opening of each of the back panel pockets wherein when the back panel flap is lifted away from the back panel pocket, the back panel pocket is accessible;

a back panel ventilation insert for each of said back panel pockets mounted in a side of the back panel pocket formed by the back panel; and straddle means for each back panel pocket comprising a straddle seat attached to an interior of the back panel pocket below the back panel ventilation insert wherein the infant's legs straddle said straddle seat thereby confining the infant in one position facing the back panel ventilation insert.

* * * * *